United States Patent [19]

Lay et al.

[11] 4,270,652

[45] Jun. 2, 1981

[54] AUTOMATIC COLLATOR UNLOADER

[75] Inventors: Roger F. Lay, Schaumburg; John S. Jarecki, Villa Park; Robert M. Koch, Wheaton, all of Ill.

[73] Assignee: AM International, Inc., Los Angeles, Calif.

[21] Appl. No.: 825,355

[22] Filed: Aug. 17, 1977

[51] Int. Cl.[2] ..... B65G 47/52

[52] U.S. Cl. ..... 198/486; 198/696; 271/85; 271/287; 414/753

[58] Field of Search ..... 198/486, 479, 650, 696, 198/620, 624, 627; 214/1 B, 309, 8.5 C; 271/85, 268, 173, 64; 294/116, 106; 72/422; 414/20, 753, 755

[56] References Cited

U.S. PATENT DOCUMENTS

| | | | |
|---|---|---|---|
| 2,959,412 | 11/1960 | Sjostrom | 271/85 X |
| 3,087,629 | 4/1963 | Sharpe | 198/486 X |
| 3,386,564 | 6/1968 | Pease | 198/627 |
| 3,995,748 | 12/1976 | Looney | 271/173X |

*Primary Examiner*—Robert B. Reeves
*Assistant Examiner*—Douglas D. Watts
*Attorney, Agent, or Firm*—Anthony W. Karambelas; George Jameson; Russell L. Root

[57] ABSTRACT

There is provided for use with a conveyor, an unloading apparatus for automatically removing a stack of sheets from a succession of shelves or bins, as in a collator, and conveying it to a desired location. The unloading apparatus includes a gripper which is adapted to advance to grip the sheets as presented on a shelf and then retract to insert the stack of sheets onto a conveyor, e.g. a tape conveyor. The gripper includes a four-bar linkage whereby the upper one of its jaws is elevated from a position beneath the plane of travel of the stack of sheets into gripping relation with the stack by a spring biased over-center action. The gripper with the stack is moved linearly onto the conveyor which takes over from the gripper to continue the movement of the stack of sheets. At the delivery end of the gripper stroke, the four-bar linkage is actuated in an opposite direction, the stack released, and the upper jaw retracted out of the path of the stack. The gripper is then linearly returned to its original position for acceptance of a succeeding stack.

12 Claims, 8 Drawing Figures

AUTOMATIC COLLATOR UNLOADER

BACKGROUND OF THE INVENTION

This application relates to an apparatus for automatically unloading stacks of sheet material articles from a collator. It relates particularly to a mechanism for pulling stacks of material out of the bins of a collator such as a rotary collator, and for transporting the stack of sheet material articles onto a moving conveyor.

Rotary collators generally include a series of bins which are supported on a rotatable drum. The drum is indexable past a sheet feeding location at which the sheet material articles are fed into the bins in a predetermined order, to form stacks of collated sheet material articles in the bins. Collated sets of sheet material articles are generally removed from the bins at a circumferentially spaced location and they are then deposited into a trough wherein they are jogged and stapled. In the past it has been conventional to unload the stacks of sheet material articles from the collator bins by hand and to manually deposit them in the trough. While automated picker type mechanisms, per se, have been known for picking sheet material articles, an example of one being U.S. Pat. No. 2,940,750, these picker mechanisms have generally been provided in an environment in which they are designed to pick one sheet at a time from a stack of materials.

SUMMARY OF THE INVENTION

The present invention provides what is a new and improved automatic unloading mechanism for unloading complete successive stacks of sheet material articles from a series of shelves or bins presented at an unloading point and for automatically delivering the stacks of articles to a conveyor from which they are transported to a use location. The present invention provides an unloader mechanism which has particular utility in connection with a rotating collator in which a series of stack carrying bins are indexed past an unloading station, and where the stacks of materials are transported by conveyor means to a trough.

According to one feature of the invention an unloader conveyor is provided, preferably in the nature of a belt conveyor for transporting stacks of sheet material articles unloaded from the collator bins. An unloading mechanism includes a housing which is linearly movable toward and away from the bins. As the housing approaches a stack of material supported in a bin, a pair of gripper jaws carried by the housing are actuated to engage and grip the entire stack of sheet material articles carried by the bin. The housing and gripper are then automatically retracted away from the bins, and are designed to deliver the unloaded stack of sheet material articles to moving conveyor belts. The gripper is further designed to release the sheet material articles for movement by the belts and to further retract itself to a position in which it is returned toward the unloading point of the while avoiding contact with the just relased stack of sheet material articles.

The present invention is believed to provide a mechanism for unloading sheets of materials from a collator which is further simple in construction, and yet which is reliable in withdrawing stacks of sheet material articles from an indexable collating mechanism.

BRIEF DESCRIPTION OF THE DRAWINGS

The further advantages and features of this invention will become further apparent from the following detailed description, taken with reference to the accompanying drawings wherein.

DETAILED DESCRIPTION OF THE DRAWINGS

Figure 1:
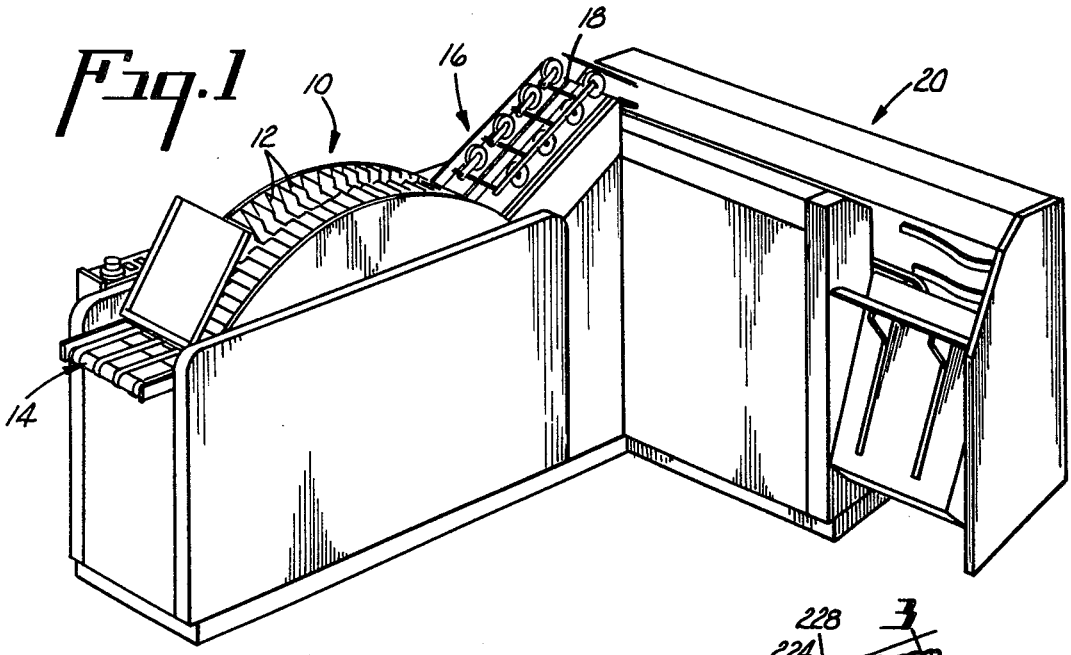
FIG. 1 is a perspective view of a collating apparatus and a material handling apparatus including the automatic unloader according to the present invention.

Referring now more particularly to FIG. 1, there is here shown in perspective an apparatus in which the unloader of the present invention is utilized and showing the manner of using the device. Thus, there is provided a rotary collator 10 composed of a plurality of individual shelves or bins 12 and into which bins 12 sheets are delivered by means, for example, of a tape conveyor 14. After the requisite number of sheets have been delivered to the bins of the collator 10 to complete the job, for example a given number of printed sheets forming a booklet, the stacks of sheets in the bins are delivered from the collator 10 to an unloader or unloading apparatus 16 which includes as a part thereof a gripper or gripper assembly P, the details of which are more particularly shown in subsequent figures. The unloader 16 includes again a conveyor 18 which may be of the tape conveyor type. The conveyor 18 delivers the stacks of sheets to an apparatus for performing a further operation on the sheets such as a jogger and stapler 20. A typical example of a rotary collator 10 is one which is shown in U.S. Pat. No. 3,076,647. A typical example of a jogger stapler useful in accordance with the present invention is one which is shown in U.S. Pat. No. 3,191,838.

Figure 2:
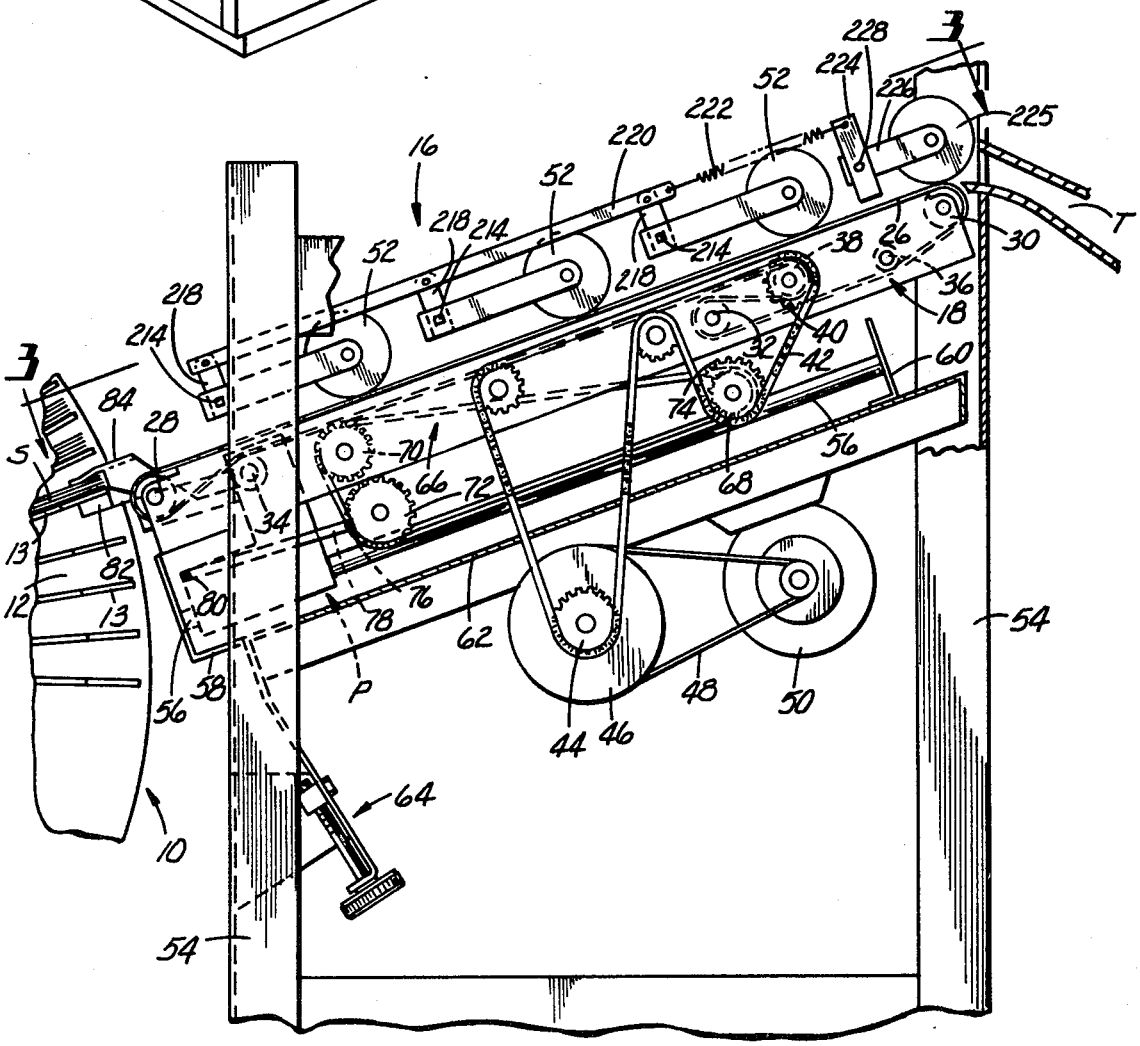
FIG. 2 is a side elevational view of the unloading apparatus according to the invention with parts omitted.

FIG. 2 shows on an enlarged scale an unloading apparatus 16 in operative association with a rotary collator 10. The unloader 16 as shown in FIG. 2 includes basically three major sections: a gripper assembly, a chain drive, and a conveyor. The conveyor portion 18 is composed of a plurality of endless transport belts 26 reaved about a head roller 28 at the inlet end of the conveyor and a tail roller 30 at the delivery end of the conveyor. Intermediate rollers such as tensioning roller 32 and idler rollers 34 and 36, and drive roller 38 are provided in a known manner. The drive roller 38 is driven by means of a sprocket 40 coacting with a chain 42 from a drive sprocket 44. The drive sprocket 44 is driven by a pulley 46, a belt 48 and a motor 50.

Suitable stabilizing rollers 52 are provided for coaction with the transport belt 26 to maintain the stack of sheets together in the course of traversing the unloader 16. The operation of the rollers 52 in coaction with the transport belts 26 is discussed in detail hereinafter.

Figure 3:
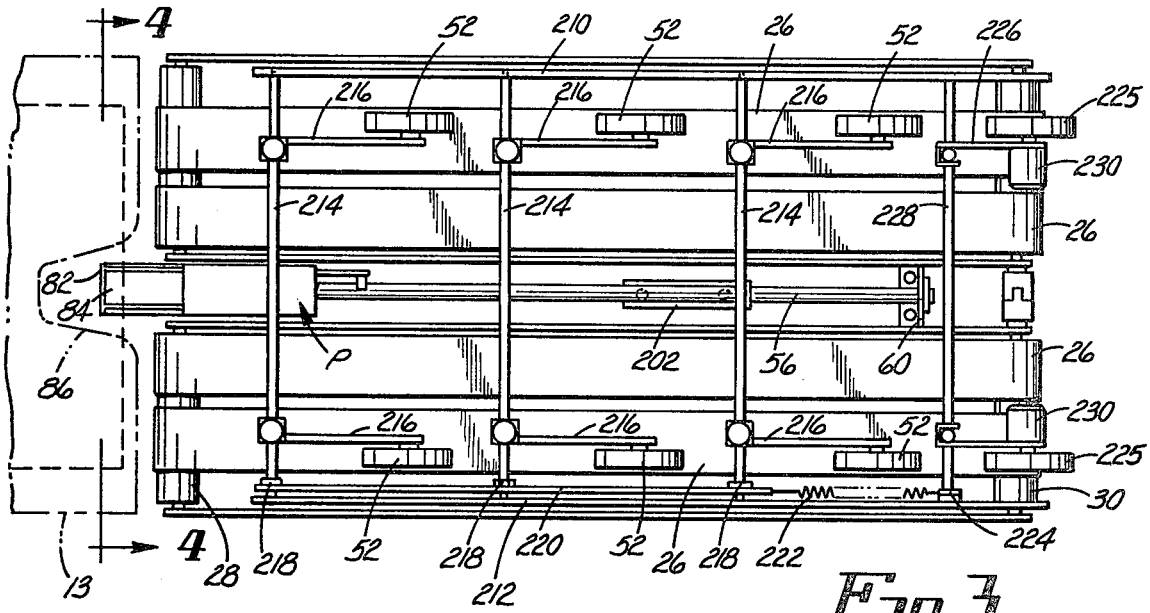
FIG. 3 is a top view of the unloading apparatus of the present invention.

As best shown in FIG. 3, there are two belts 26 disposed on either side of the gripper or gripper assembly P for supporting and removing the stacks of paper sheets S. The conveyor runs at the same speed as the gripper P on its unload stroke in order to eliminate any relative movement between the stack S and the belt while the gripper P is engaged with the stack.

The conveyor assembly including the transport belts 26 and the head and tail rollers 28 and 30 is secured in a known manner to an unloader frame 54, and desirably includes means for adjusting the angle of elevation of the unloader assembly.

Also provided and supported by the frame 54 is the gripper P for removing a stack of sheets from the collator 10 and transferring the stack S to the transport belts 26 and exit from the unloader 16 through a trough T. The gripper generally indicated by the letter P is adapted to move along a fixed path such as provided by the bar 56, which path is generally parallel to the upper reach of the transport belt 26. The bar 56 is anchored to a supporting frame 58 at its proximal extremity, and to a suitable bracket 60 at its distal extremity, the bracket 60 being secured to a base or bottom plate 62 adjustably mounted in the unloader frame 54. The bar 56 is located so as to be on the centerline of the collator 10. Suitable adjustment means generally indicated at 64 enable careful adjustment of the elevation of the bottom plate 62 and accordingly the pathway provided by the bar 56.

Motion of the gripper P along the bar 56 is provided by a separate drive chain 66 reaved about a drive sprocket 68, a dwell sprocket 70 and a return sprocket 72. In the embodiment shown in FIG. 2, the drive sprocket 68 is coaxial with a conveyor drive sprocket 74. The sprockets 68, 70 and 72 are suitably mounted on sprocket pins carried by the supporting frame 58, and suitably journalled thereon in a known manner. The connection between the chain 66 and the gripper P is made through a chain link pin 76 and a drive link 78 which in turn is pivotally secured to the gripper P through a pin 80. Thus, as the chain 66 courses in a counterclockwise manner as shown in FIG. 2 around the sprockets 68, 70 and 72, the gripper P leaves its proximal position and moves rearwardly toward the remote end of the bar 56. Thereafter, the gripper P changes direction as the chain moves around the drive sprocket 68 and moves toward the proximal end of the unloader 16 with the link pin 76 moving along the upper reach of the chain 66. As the chain courses around the dwell sprocket 70, the gripper P is held substantially stationary while the drive link 78 is moved in a downward direction and actuates mechanism which will be described below for effecting engagement of the gripper jaws 82 and 84 on an exposed marginal edge of the stack of papers S for unloading from the collator 10. The chain 66, in the current embodiment, produces reciprocation of the gripper assembly P of approximately one cycle per second. As best shown in FIG. 3, the jaws extend into a recess 86 in a bin divider 13 a distance sufficient to embrace the edge of the stack of papers indicated by broken lines in FIG. 3. The projection into the periphery of the collator 10 is best shown in side elevation in FIG. 2.

Figure 4:
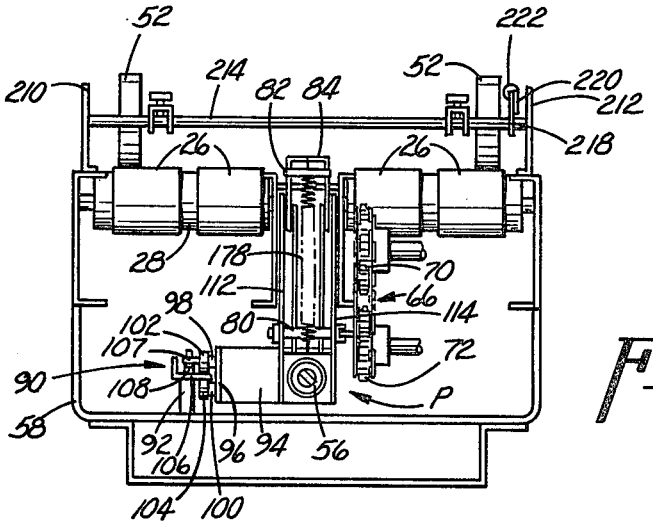
FIG. 4 is a front view of the unloading apparatus of FIG. 3, taken from the direction 4—4 of FIG. 3.

FIG. 4 is a front view of the proximal end of the unloader of the present invention and showing in front elevation the gripper.

In order to stabilize the gripper P against rotation about the bar 56, there is provided a guide track 90 secured to the supporting frame 58 on a pedestal 92. The guide track 90 is desirably of L-shaped cross section as shown in FIG. 4. The gripper P is provided with a bracket 94 extending laterally therefrom and suitably secured thereto. Extending from the bracket 94 is a vertically extending flange 96 which is provided with a pair of spaced laterally extending pins 98 and 100 on which stabilizing rollers 102 and 104 are journalled for rotation. The rollers 102 and 104 are disposed on axes so that they are sufficiently spaced to accept therebetween the laterally extending leg 106 of the guide track 90. There is also conveniently provided on the upper pin 98 an extension 107 for striking the activating arm of an electric switch 108 which controls the collator in such a way that the gripper must be in a predetermined position in its cycle to trigger indexing of the collator to the next station.

Thus it will be seen that the stability of the gripper P is ensured by the coaction between the laterally extending leg 106 of the guide 90 and the stabilizing rollers 102 and 104 coacting on opposite sides thereof.

Figure 6:
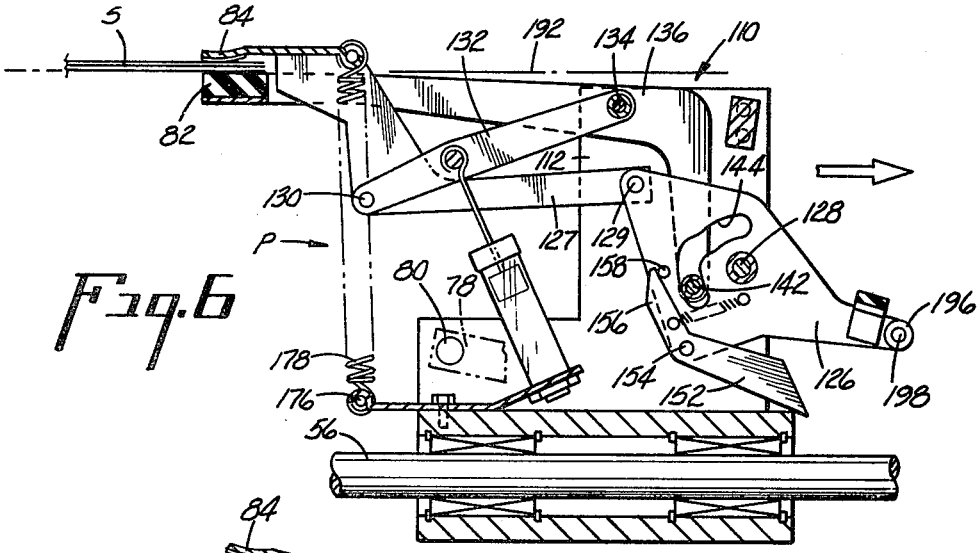
FIGS. 5, 6 and 7 are sectional elevations of the sheet gripping mechanism of the present invention in selected positions of movement.
Figure 7:
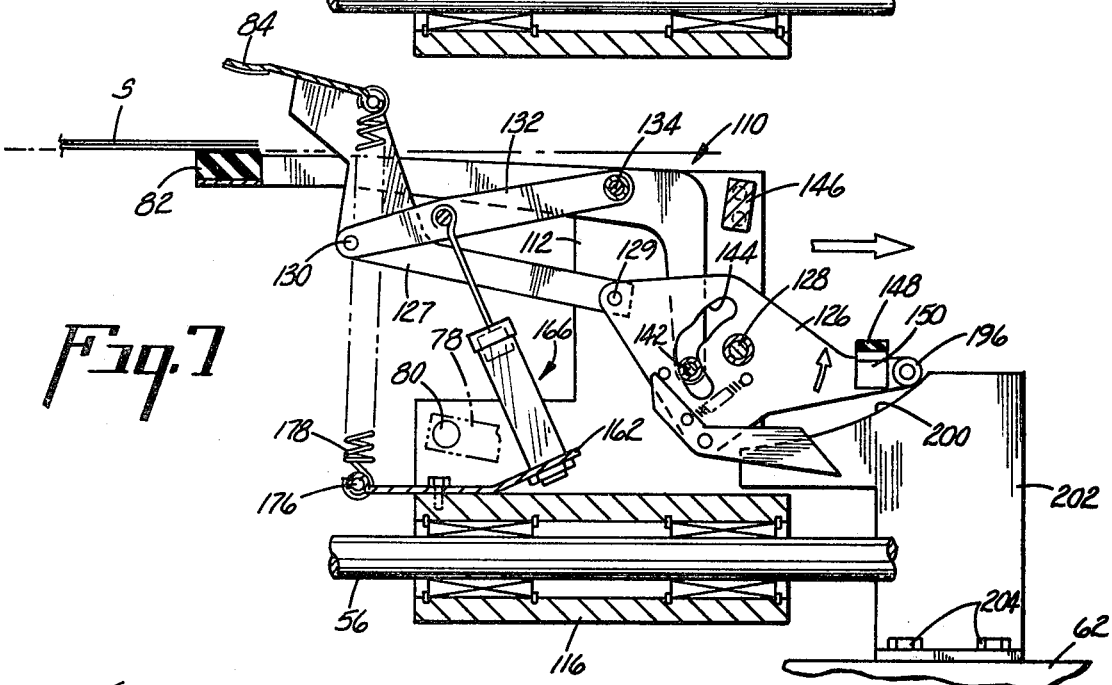
Figure 5:
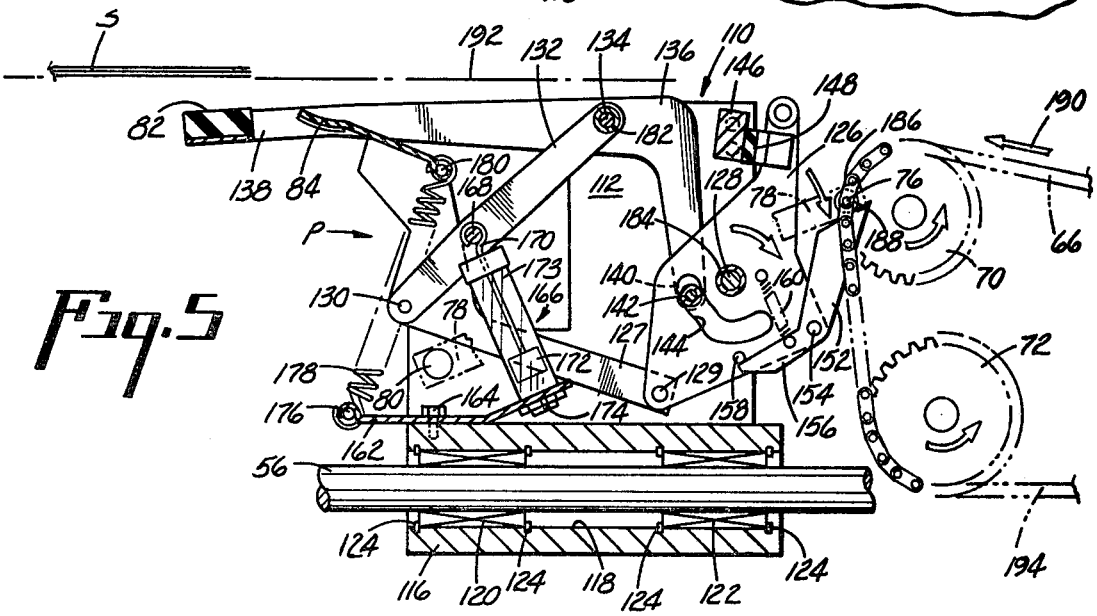

FIGS. 5, 6 and 7 show the sheet gripping mechanism of the present invention in selected positions of movement, and illustrate the details of the linkages contained therein and their manner of operation. Referring now more particularly to FIG. 5, the gripper P is shown at its proximal extremity of travel on the bar 56. The gripper P is composed of a housing or housing member 110 provided by parallel side plates 112 and 114 (FIG. 4). The side plate 114 has been removed in FIGS. 5, 6 and 7 for better visibility of the working parts.

As indicated above, the gripper P moves along a bar 56. To accommodate support of the gripper P on the bar 56 for such longitudinal movement, there is provided a sleeve 116 having a bore 118 extending therethrough. The sleeve 116 desirably has a square or rectangular outer periphery for convenient mounting of the side plates 112 and 114. To support the gripper P on the bar 56, there are provided at opposite ends of the sleeve 116 sleeve type recirculating ball bearings 120 and 122 suitably retained as by snap rings 124. The lateral spacing of the sleeve type recirculating ball bearings 120 and 122 provide stability for the gripper about a transverse axis.

The gripper actuating means is basically a four-bar linkage with a spring to produce toggle action. The top or upper jaw 84 is a part of a link 127 which is one of the four links, and toggles closed or open depending upon the motion of a crank link or crank bar 126 which is another of the four bars. Counterclockwise rotation of the crank link 126 about the fixed or stationary pin 128 carried by and extending between the side plates 112 and 114 and as shown in the drawings will toggle the jaw 84 open, while clockwise motion will toggle the jaw 84 to a closed position. The link 127 which carries the jaw 84 is pivotally connected to a floating pivot pin 129 at one end, and to a second floating pivot pin 130 at its other end. The pivot pin 130 coacts between the link 127 and a third link 132. The opposite end of the third link 132 is pivotally secured to a fixed pin 134 supported by and extending between the parallel side plates 112 and 114. The side plates 112 and 114 joining the fixed pins 128 and 134 constitute, of course, the fourth bar of the linkage. Also pivotally mounted on the fixed pin 134, albeit independently of the third link 132, is a lever 136 having a projection 138 extending therefrom and carrying at its distal extremity a bottom or lower jaw 82. The lever 136 carries at its opposite free end 140 a cam follower bar 142 which coacts in a cam slot 144 in the crank link 126. Thus, as the crank link 126 pivots about the fixed pin 128, the cam slot 144 coacts with the cam follower bar 142 to effect a movement of the lever 136 about the fixed pin 134 thereby causing the lower jaw 82 to raise or lower itself slightly depending upon the direction of rotation of the crank link 126.

From the foregoing it may be seen that the jaw 82 is essentially a passive jaw which is given a slight movement for reasons explained hereinafter. The jaw 84, on the other hand may be termed the active jaw and performs a complex opening and closing movement which will presently be described in detail.

As shown in FIG. 5, there is provided between the side plates 112 and 114 a spacer bar 146 which also serves as a stop for counterclockwise rotation of the crank bar 126. A bumber stop pad 148 mounted on a bracket 150 (see FIG. 7) carried by the free end of the bar 126 abuts against the spacer bar 146 to prevent further counterclockwise rotation thereof.

Considering the position of the four-bar actuating means as shown in FIG. 5, actuation of movement of the linkage system is initiated in the following manner. The crank bar 126 is provided with a pawl 152 pivotally secured at 154 to the crank bar 126. The pawl 152 has an extension 156 which abuts at its distal extremity a fixed pin 158 on the crank bar 126, and is held in that position by means of a spring 160. Thus, the pawl 152 will engage a downwardly moving element, but allow that element to pass upwardly past the free end of the pawl 152.

As shown in FIG. 5, the sleeve 116 carries at its forward end a bracket 162 secured thereto by any suitable means such as screw 164. The bracket 162 provides a mounting for a dash pot assembly 166 which provides downward damping. The dash pot 166 is secured to the third link 132 by means of a pin 168 and a hook 170 which is in turn connected to a piston 172. Air is allowed to escape from the dash pot assembly 166 through a small diameter port or air bleed vent 174 which may be valved for better control. The outer extremity of the bracket 162 is configured for holding a pin 176, and one end of an over-center spring 178. The opposite end of the over-center spring 178 is attached to the extension of the bar 127 which carries the jaw 84 at a spring retaining pin 180. The spring 178 holds the linkage in either of its two over-center positions, one of which is illustrated in FIG. 5.

Although in the previous discussion, the four-bar linkage assembly has been discussed in terms of single bar members, in a preferred embodiment, these members are duplicated and spaced from each other by suitable spacer bushings, such as bushing 182 and bushing 184. While the apparatus can be constructed and operated with a single set of the four-bar linkage, the preferred embodiment provides for a duplication of the linkage assembly as best indicated in FIG. 4.

As indicated in FIG. 5, there is pivotally secured to the housing 110 a drive link 78 mounted on a pin 80 for rotation thereabout. At its other end the drive link 78 is provided with a pin 76 which is dimensioned to fit through a hole in a link 186 of the drive chain 66. A free end of the pin 76 is provided with a camming sleeve or roller 188 which is adapted to engage the pawl 152. In FIG. 5, the linkage of the gripper P is shown in the condition it would exhibit when the pin 76 occupies position V of FIG. 8, i.e. with the camming sleeve 188 shown as it initially contacts the free end of the pawl 152. The chain 66 is moving in a counterclockwise direction as indicated by the arrow 190.

As the chain 66 continues its course through the dwell section D between sprockets 70 and 72, the pawl 152 is forced downwardly and, through its action against the pin 158, effects rotation of the link 126 about the pin 128. When the chain has moved through the dwell section D and begins to turn around the lower portion of the sprocket 72 the linkage snaps to its other over-center position, the condition of the link bars being then as shown in FIG. 6. It will be noted that the jaws 82 and 84 are now in gripping engagement with one edge of a stack of sheets S being unloaded from the collator 10 and moved onto the unloader conveyor. The contact of jaw 84 with the paper stack (or with the lower jaw 82) limits the travel of the linkage in this direction. The plane of the path of the paper sheet stack is indicated by the line 192. The pin 76 on the distal extremity of the drive link 78 now begins travel through a horizontal reach 194 (FIG. 5) causing movement of the gripper assembly P to the right as shown by the arrow in FIG. 6.

The bar 126 is provided at its free end with a cam follower 196 in the form of a roller mounted for rotation on a pin 198. At the end of the retraction stroke along the bar 56 where the chain 66 turns about the drive sprocket 68, (i.e. at the position indicated as VII in FIG. 8) the cam follower 196 engages a stationary cam surface 200 carried on a cam plate 202 secured by any suitable means such as screws 204 to the base plate 62. As shown in FIG. 7, the engagement of the cam follower 196 with the cam surface 200 effects a counterclockwise rotation of the bar 126 about the stationary pin 128. The motion within the four-bar linkage caused by this camming action is sufficient to rearrange the force applications so that the linkage assumes an over-center condition with respect to the position shown in FIG. 6, whereby the entire assembly, by virtue of the spring bias, returns quickly to the position shown in FIG. 5. The dash pot assembly 166 coacting between the link 132 and the bracket 162, smooths and quiets this snap action.

By way of clarification the FIG. 7 position is approximately the arrangement in which the forces within the linkage are balanced and the linkage finds itself on dead center. Any actuation of the crank bar 126 to raise the pivot pin 129 above its FIG. 7 location will cause the linkage to snap to the FIG. 6 position, and any actuation in a direction causing pivot pin 129 to move below its FIG. 7 location will cause the linkage to snap to the FIG. 5 position.

Also, as the cam follower 196 moves up the cam surface 200, the upper jaw 84 moves through an arc upwardly and away from the stack of sheets S which have now, by reason of the movement of the gripper assembly rearwardly as shown in FIG. 6, come to rest upon the conveyor endless transport belts 26. The path that the upper jaw 84 follows by reason of the action of the four-bar linkage is upwardly and to the rear as shown in FIG. 7 and then rapidly downwardly and around the free end of the stack of sheets S to a fully retracted position below the stack path as shown in FIG. 5. Simultaneously, because of the action of the cam slot 144 in the crank bar 126 upon the cam follower bar 142 attached to the lever 136, the jaw 82 is moved downwardly slightly to the position shown in FIG. 5 from its position as shown in FIG. 7. By this time, the pin 76 on the drive chain 66 has turned around the drive sprocket 68, and is now effecting movement of the gripper assembly P to the left, passing underneath the stack of sheets S as it is now moved by the conveyor endless transport belts 26 (FIG. 2). The gripper P is then transported to a position such as shown in FIG. 2 where the action of the four-bar linkage shown being just initiated in FIG. 5 is commenced and the jaws 82 and 84 caused to grip the edge of another stack of sheets S in the collator 10 as shown in FIG. 6. The cycle is then continued.

Figure 8:
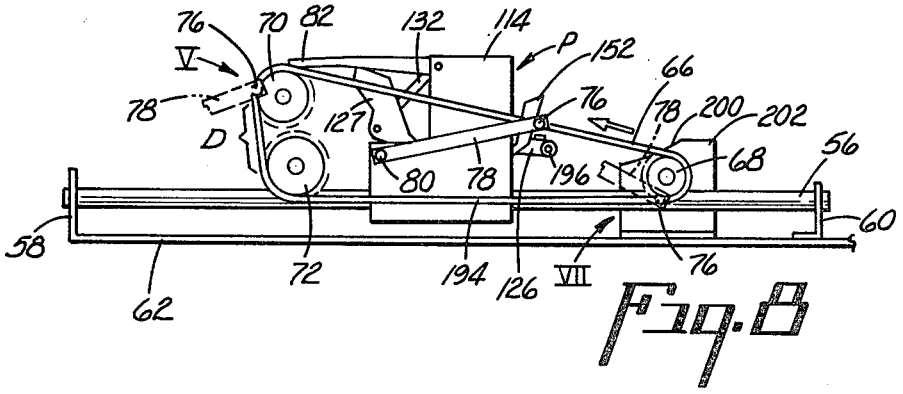
FIG. 8 is a schematic elevation of the movable housing portion of the unloader according to the invention.

FIG. 8 shows in diagrammatic and schematic form the position of the drive link 78 relative to the housing side plate 114 as it traverses the upper reach of the chain 66. In dotted lines, the position of the drive link 78 is shown as it turns into the dwell section D defined by sprockets 70 and 72, the pin 76 then being in position V. Also in dotted lines is shown the position of the drive link 78 as it begins to turn around the drive sprocket 68, the pin then being in position VII. The cam plate 202 is shown in position adjacent the drive sprocket 68. The gripper P moves along the bar 56 to the right as shown in FIG. 8 at a speed which is equal to the conveyor belt speed. Just before the end of the unload stroke where the drive link pin 76 is traveling and about to turn around the drive sprocket 68, the cam follower 196 rides up the stationary cam surface 200 causing counterclockwise rotation of the crank 126 as shown in FIG. 7. When the jaw 84 reaches the top of the arc of travel (over-center position), the over-center spring 178 toggles the jaw 84 open until the bumper stop pad 148 engages the spacer-bar 146. The top jaw 84 is now fully open and under the paper path 192 as shown in FIG. 5. This position occurs just before the chain reverses the gripper travel along the bar 56. Once open, the gripper goes back on the return stroke under the advancing paper stack and the collator advances to the next pocket, being indexed by the action of extension 107 upon switch 108 (FIG. 4) previously described.

It will be observed that the requirements of the lower jaw 82 are such that it must be in line or above the paper path when pulling the stack S, but below the paper path on the return stroke to avoid dragging on the bottom of the just released stack of paper as the conveyor 18 carries it away, and to avoid stumbling against the edge of the paper stack S in the next collator bin. As indicated above, this motion is accomplished by the cam slot 144 in the crank plate 126. The lever 136 which carries the lower jaw 82 is pivoted in the frame defined by the side plates 112 and 114 on the fixed pin 134. The cam follower bar 142 attached to the lever 136 rides in the slot 144 and follows its contour as the crank bar 126 rotates. The movement of the cam follower bar 142 in the slot 144 causes the jaw 82 to lower approximately one quarter of an inch when the crank bar 126 turns counterclockwise with the top jaw 84 opening, and to rise about a quarter of an inch as the crank bar 126 turns clockwise.

The top jaw 84 is constrained to follow an arcuate path in its closing movement, and this path carries it to a sufficient height above the lower jaw 82 that it can easily accommodate a paper stack of the greatest thickness which the collator can process. Both the top and bottom jaws have an attached cork-rubber pad to provide friction when gripping the stack S. The stop pad 148 (FIG. 7) is conveniently formed of a cork-neoprene sponge. The stop pad 148 acts as a cushion when it stops the crank bar 126 in the open position as shown in FIG. 5 after hitting the spacer bar 146. The over-center spring 178 must have sufficient force to clamp the jaws 82 and 84 on the stack S and hold the stack S when pulling it out of the collator 10.

The dash pot 166 is used to dampen the opening motion of the top jaw 84. It consists of a piston 172 in an air tight cylinder 173 with an air bleed vent 174 at the bottom for controlling the amount of damping. Valving in the piston 172 may be provided to allow damping to occur only in the downward direction of the top jaw 84. The dash pot 166 absorbs the opening energy of the top jaw 84, reduces jaw bounce which can cause interference with the advancing paper stack on the return stroke, and reduces impact noise.

As indicated above, the pawl 152 attached to the crank 126 is spring loaded by means of a spring 160 so that it can move out of the way of the camming sleeves or roller 188 (FIG. 5) on its upstroke, but catches the roller 188 on the downstroke to rotate the crank 126 and close the jaws 82 and 84.

Turning now to a consideration of the operation of the conveyor 18, it will be seen the roller assembly including stabilizing rollers 52 is carried by side plates 210 and 212 (FIGS. 3 and 4) forming part of the supporting frame 58. These side plates have been omitted from FIG. 2 so that the operation of the rollers 52 may be more readily visualized. The side plates 210 and 212 support between them rockable cross shafts 214 which have squared central driving portions which mesh with squared openings in arms 216, each of which supports a roller 52 at its distal end. The cross shafts, and hence their rollers, are spaced at intervals substantially less than the lengths of paper sheets normally being handled. In the preferred embodiment, they are, for example, about seven inches apart. Also mounted on each of the cross shafts 214 is an operating arm 218 each of which has a square opening drivingly connected with the square portion of its cross shaft. The distal ends of the arms 218 are all connected by a bar 220 which is connected to one end of a tension spring 222. The spring 222 is connected at its other end to a spring perch 224 suitably affixed to the adjacent side plate 212 and, through the bar 220, urges all of the operating arms 218 to the right as seen in FIG. 2.

It is apparent that all of the rollers 52 are thus urged by the spring 222 into engagement with the belts 26 of the conveyor 18, and that, by reason of the bar 220, they will all occupy about the same spacing in relation to the belts 26.

The rollers 225 which appear at the right of FIG. 2 are independent of the others and their support arms 226 are pivoted on a cross shaft 228. Weights 230 (FIG. 3) urge the rollers toward the belts 26 of the conveyor 18.

While the conveying of sheets by belt transports is conventional, special problems arise when the conveyed items are stacks of sheets which must be retained in compact substantially unshingled condition.

To avoid the tendency of the rollers 52 to cause shingling of the stacks of sheets as their leading edges come into contact with the rollers, the first pair of rollers 52 (leftmost in FIG. 2) are located at a point such that the gripper P will still be tightly gripping the stack as it passes under such rollers, and the gripper does not release the stack until the lead end thereof arrives at a point between the first pair of rollers and the second. As a result, the stack is securely clamped against shingling while encountering and raising the first pair of rollers 52.

At the time this happens, the remaining rollers 52, through the action of bar 220, are also raised to a level substantially equalling the level of the first pair of rollers. Thus, as the stack being transported encounters each set of rollers, its lead portion will strike the already raised roller very lightly with the result that the roller will have virtually no tendency to shingle the sheets, especially since they are being retained in a stacked condition by the pressure of a previous roller. Each stack of sheets will accordingly be passed bodily along the endless transport belts 26 from roller to roller until the last roller pair 225, 225 forwards it into the trough T for further transportation, processing and treatment, with no significant shingling of the stack during the procedure.

The operation has been described in relation to a situation wherein the gripper P, through the extension 107, activates a switch 108 in a control circuit for the collator to generate a pulse which signals stepping of the collator to the next bin, so that the collator is slaved to the cycle of the gripper. In other cases where the relative operating speeds are different, it will be understood that the unloader action can be wired to have its operation tripped by collator motion, or both the cycling of the unloader and stepping of the collator can be activated by some appropriate common signalling source as desired. Of course if the collator bins are stationary, then the signal pulse will have the result of causing the unloading mechanism to step instead of the collator.

Although this invention has been described in reference to a collator with movable bins, it will be understood that the present invention may also be used in connection with unloading a fixed bin collator. This is accomplished by moving the entire mechanism past the bin mouths in a direction generally normal to that of the withdrawal path. The unloading then takes place after moving the unloader 54 into alignment with each of the stationary bins of such a collator instead of moving the bins 13 into alignment with a stationary unloader as is done in the rotary collating system shown and described herein.

What is claimed is:

1. A sheet handling apparatus comprising: a collator including a series of sheet holding bins for holding separate stacks of sheets, a conveyor for transporting stacks of sheets from said collator serially to a subsequent operation, and a gripper coacting between said collator and said conveyor for removing said stacks serially from said collator and transferring them to said conveyor, said gripper comprising a housing, means for reciprocably moving said housing along a linear pathway between a first position where a stack of sheets in a bin in said collator is gripped, and a second position where said stack of sheets is released to said conveyor, stack gripping means carried by the housing, means for actuating said gripping means at said first position to a stack gripping condition, and separate means for actuating said gripping means to a releasing condition in said second position, said stack gripping means including a pair of jaws and means coacting therewith for opening and closing said jaws, said jaw opening and closing means including a four-bar linkage, one of said jaws being carried by a link in said four-bar linkage and the other by said housing, said four-bar linkage including a crank link pivotally mounted in the housing, and said actuating means including means coacting between said crank link and said means for reciprocably moving said housing along a linear pathway for toggling said four-bar linkage to a gripping position.

2. A sheet handling apparatus comprising: a collator including a series of sheet holding bins for holding separate stacks of sheets, a conveyor for transporting stacks of sheets from said collator serially to a subsequent operation, and a gripper coacting between said collator and said conveyor for removing said stacks serially from said collator and transferring them to said conveyor, said gripper comprising a housing, means for reciprocably moving said housing along a linear pathway between a first position where a stack of sheets in a bin in said collator is gripped, and a second position where said stack of sheets is released to said conveyor, stack gripping means carried by the housing, means for actuating said gripping means at said first position to a stack gripping condition, and separate means for actuating said gripping means to a releasing condition in said second position, said stack gripping means including a pair of jaws and means coacting therewith for opening and closing said jaws, said jaw opening and closing means including a four-bar linkage, one of said jaws being carried by a link in said four-bar linkage and the other by said housing, said four-bar linkage including a crank link pivotally mounted in the housing, and said separate means including means along said linear pathway coacting with said crank link for toggling said four-bar linkage to a releasing position.

3. A sheet handling apparatus in accordance with claim 1 wherein the means for reciprocably moving said housing along a linear pathway includes a chain and sprocket assembly, and a link pivotally secured to the housing at one end thereof and pivotally secured to the chain at the other end thereof, and the toggling means to a gripping position includes a projection from said link and a pawl operatively associated with said crank link for turning said crank link about its pivot in a single direction only.

4. A sheet handling apparatus in accordance with claim 2 wherein the toggling means along the pathway includes a cam surface along said pathway and a cam follower on said crank link engageable with said cam surface as the housing approaches said second position to turn said crank link about its pivot in a single direction only, and thereby release said stack.

5. A sheet handling apparatus comprising a collator including a series of sheet holding bins for holding separate stacks of sheets, a conveyor for transporting stacks of sheets from said collator serially to a subsequent operation, and a gripper coacting between said collator and said conveyor for removing said stacks serially from said collator and transferring them to said conveyor, a supporting frame for said gripper and conveyor, said gripper comprising a housing; first means for reciprocably moving said housing along a linear pathway between a first position where a stack of sheets in a bin in said collator is gripped and a second position where said stack of sheets is released to said conveyor, said first means including a bar fixed to said supporting frame and a sleeve carried by the housing surrounding said bar, and a chain reaved around a drive sprocket located adjacent one end of said bar and a pair of spaced dwell sprockets located adjacent the other end of said bar, one of said dwell sprockets and said drive sprocket defining a chain reach parallel to said bar, said dwell sprockets defining a dwell chain reach disposed at an angle to said bar and a drive link pivotally secured to the housing at one end thereof and pivotally secured to the chain at the other end thereof, the angular disposition of the dwell sprockets and the chain reach defined thereby being such that the housing remains substantially stationary on the bar during traverse of the dwell reach by the end of said link attached to said chain and to said housing; stack gripping means carried by the housing including an upper jaw and lower jaw and a four-bar linkage for opening and closing said jaws, said upper jaw being carried by a link in said four bar linkage and the lower jaw by a lever pivoted on said housiing, said upper jaw being biased by a spring in a a gripping position and in a releasing position by the same spring operative between over-center positions, said lever being movable between a stack gripping position of the lower jaw while the housing is moved from the first position on said linear pathway to the second position thereon and a releasing position while the housing is moved from the second position on said linear pathway to the first position thereon; said four-bar linkage including a crank link pivotally mounted in the housing, said crank link having operatively associated therewith a pawl, said drive link having at the end attached to said chain a pawl-engaging member for toggling the four-bar linkage to a gripping position as the end of said drive link traverses the dwell reach of said chain, said supporting frame having a cam surface affixed thereto adjacent the end of said bar corresponding to said second position on said linear pathway, a cam follower carried by said crank link whereby when said housing approaches said second position, the cam follower engages said cam surface to toggle said four bar linkage to a releasing position, said crank link also including a cam slot and said lever having a pin adapted to move relative to said cam slot as the crank link rotates about its pivot, whereby the lower jaw is moved between its gripping position and its releasing position, said crank link being pivotally connected to the link in said four bar linkage carrying said upper jaw, said pivotal connection being movable over-center between a releasing position and a gripping position.

6. An unloading device for automatically unloading in succession stacks of sheet material from a series of shelves and transferring each stack to a conveyor in succession comprising: a frame, a linear path defining trackway carried by said frame, a gripper comprising a housing, means carried by the housing for following said trackway, means for reciprocably moving said housing along said trackway between a first position where a stack of sheets on a shelf is gripped and a second position where said stack of sheets is released, stack gripping means carried by the housing, means for actuating said gripping means at said first position to a stack gripping condition, and separate means for actuating said gripping means to a releasing condition at said second position, said stack gripping means including a pair of jaws and means coacting therewith for opening and closing said jaws, said jaw opening and closing means including a four-bar linkage, each of said jaws being carried by a separate link in said four-bar linkage, said four-bar linkage including a crank link pivotally mounted in the housing, and said actuating means including means coacting between said crank link and said means for reciprocably moving said housing along a linear pathway for toggling said four-bar linkage to a gripping position.

7. An unloading device for automatically unloading in succession stacks of sheet material from a series of shelves and transferring each stack to a conveyor in succession comprising: a frame, a linear path defining trackway carried by said frame, a gripper comprising a housing, means carried by the housing for following said trackway, means for reciprocably moving said housing along said trackway between a first position where a stack of sheets on a shelf is gripped and a second position where said stack of sheets is released, stack gripping means carried by the housing, means for actuating said gripping means at said first position to a stack gripping condition, and separate means for actuating said gripping means to a releasing condition at said second position, said stack gripping means including a pair of jaws and means coacting therewith for opening and closing said jaws, said jaw opening and closing means including a four-bar linkage, each of said jaws being carried by a separate link in said four-bar linkage, said four-bar linkage including a crank link pivotally mounted in the housing, and said separate means for actuating said gripping means to a releasing condition including means along said linear pathway coacting with said crank link for toggling said four-bar linkage to a releasing position.

8. An unloading device in accordance with claim 6 wherein the means for reciprocably moving said housing along a linear pathway includes a chain and sprocket assembly, and a link pivotally secured to the housing at one end thereof and pivotally secured to the chain at the other end thereof, and the toggling means to a gripping position includes a projection from said link and a pawl operatively associated with said crank link for turning said crank link about its pivot in a single direction only.

9. An unloading device in accordance with claim 7 wherein the toggling means along the pathway includes a cam surface along said pathway and a cam follower on said crank link engageable with said cam surface as the housing approaches said second position to turn said crank link about its pivot in a single direction only, and thereby release said stack.

10. An unloading device for automatically unloading in succession stacks of sheet material from a series of shelves in a collator and transferring each stack to a conveyor in succession comprising a supporting frame; a housing; first means for reciprocably moving said housing along a linear pathway between a first position where a stack of sheets in a shelf in said collator is gripped and a second position where said stack of sheets is released to said conveyor, said first means including a bar fixed to said supporting frame and a sleeve carried by the housing surrounding said bar, and a chain reaved around a drive sprocket located adjacent one end of said bar and a pair of spaced dwell sprockets located adjacent the other end of said bar, one of said dwell sprockets and said drive sprocket defining a chain reach parallel to said bar, said dwell sprockets defining a dwell chain reach disposed at an angle to said bar and a drive link pivotally secured to the housing at one end thereof and pivotally secured to the chain at the other end thereof, the angular disposition of the dwell sprockets and the chain reach defined thereby being such that the housing remains substantially stationary on the bar during traverse of the dwell reach by the end of said link attached to said chain and to said housing; stack gripping means carried by the housing including an upper jaw and lower jaw and a four-bar linkage for operating said upper jaw, said upper jaw being biased by a spring in a gripping position and in a releasing position by the same spring operative between over-center positions, said lower jaw being carried by a lever pivotally mounted in the housing and movable between a stack gripping position while the housing is moved from the first position on said linear pathway to the second position thereon and a releasing position while the housing is moved from the second position on said linear pathway to the first position thereon; said four-bar linkage including a crank link pivotally mounted in the housing, said crank link having operatively associated therewith a pawl, said drive link having at the end attached to said chain a pawl-engaging member for toggling the four-bar linkage to a gripping position as the end of said drive link traverses the dwell reach of said chain, said supporting frame having a cam surface affixed thereto adjacent the end of said bar corresponding to said second position on said linear pathway, a cam follower carried by said crank link whereby when said housing approaches said second position, the cam follower engages said cam surface to toggle said four bar linkage to a releasing position, said crank link also including cam slot and said lower jaw carrying lever having a pin adapted to move relative to said cam slot as the crank link rotates about its pivot, whereby the lower jaw is moved between its gripping position and its releasing position, said crank link being pivotally connected to the link in said four bar linkage carrying said upper jaw, said pivotal connection being movable over-center between a releasing position and a gripping position.

11. An unloading device for automatically unloading in succession stacks of sheet material from a series of shelves and moving the stacks in succession to a conveyor each along a path lying in the plane of the stack, comprising a frame, a linear path defining trackway carried by said frame, a gripper comprising a housing, means carried by the housing for following said trackway, means for reciprocably moving said housing along said trackway between a first position where a stack of sheets on a shelf is gripped and a second position where said stack of sheets is released, said gripper also comprising a passive jaw mounted on the housing for engaging one face of each stack, and an active jaw mounted on the housing for moving into and out of gripping engagement with the stack in opposition to the passive jaw, and means on said housing for first imparting to said active jaw a compound motion of releasing the stack by movement away from the passive jaw and then rapid motion in the direction of stack travel combined with retraction to a position on the same side of said plane of the path as the passive jaw when the housing reaches said second position, and thereafter returning the active jaw to a position above said plane and into position to oppose said passive jaw and grip a succeeding stack when the housing reaches said first position.

12. An unloading device as set forth in claim 11 wherein the means on the housing for imparting the compound motion to the active jaw is snap acting in both directions whereby to permit time between motions for the gripper to escape past the paper stack as it is conveyed away.

* * * * *